US005141309A

United States Patent [19]

Wörwag

[11] Patent Number: 5,141,309

[45] Date of Patent: Aug. 25, 1992

[54] APPARATUS FOR INDICATING HOW DIRTY AN AIR FILTER IS IN A VACUUM-CLEANING APPARATUS, IN A ROOM FILTER, ETC.

[75] Inventor: Peter Wörwag, Romanshorn, Switzerland

[73] Assignee: Firma Fedag, Romanshorn, Switzerland

[21] Appl. No.: 695,698

[22] Filed: May 3, 1991

[30] Foreign Application Priority Data

May 5, 1990 [DE] Fed. Rep. of Germany ..... 4014442

[51] Int. Cl.[5] ..... B01D 35/143; G01N 21/59

[52] U.S. Cl. ..... 356/72; 55/274; 250/573; 340/607; 356/438

[58] Field of Search ..... 356/38, 72, 432, 438; 250/573, 574, 575; 15/339; 55/274; 340/607

[56] References Cited

U.S. PATENT DOCUMENTS

| | | | |
|---|---|---|---|
| 3,324,633 | 6/1967 | Revell | 55/274 |
| 3,484,772 | 12/1969 | Niewyk et al. | 340/607 |
| 3,820,897 | 6/1974 | Roess | 356/301 |
| 4,986,839 | 1/1991 | Wertz et al. | 55/274 |

FOREIGN PATENT DOCUMENTS

| | | | |
|---|---|---|---|
| 64-01930 | 1/1989 | Japan | 356/438 |

*Primary Examiner*—Vincent P. McGraw
*Attorney, Agent, or Firm*—Robert W. Becker & Associates

[57] ABSTRACT

An apparatus is provided for indicating how dirty an air filter is that is disposed in an air stream for removing dirt therefrom. The apparatus includes an arrangement in the form of a light unit for measuring how dirty the air filter is. The apparatus also includes an indicator that is connected to the light unit.

6 Claims, 2 Drawing Sheets

Fig. 3
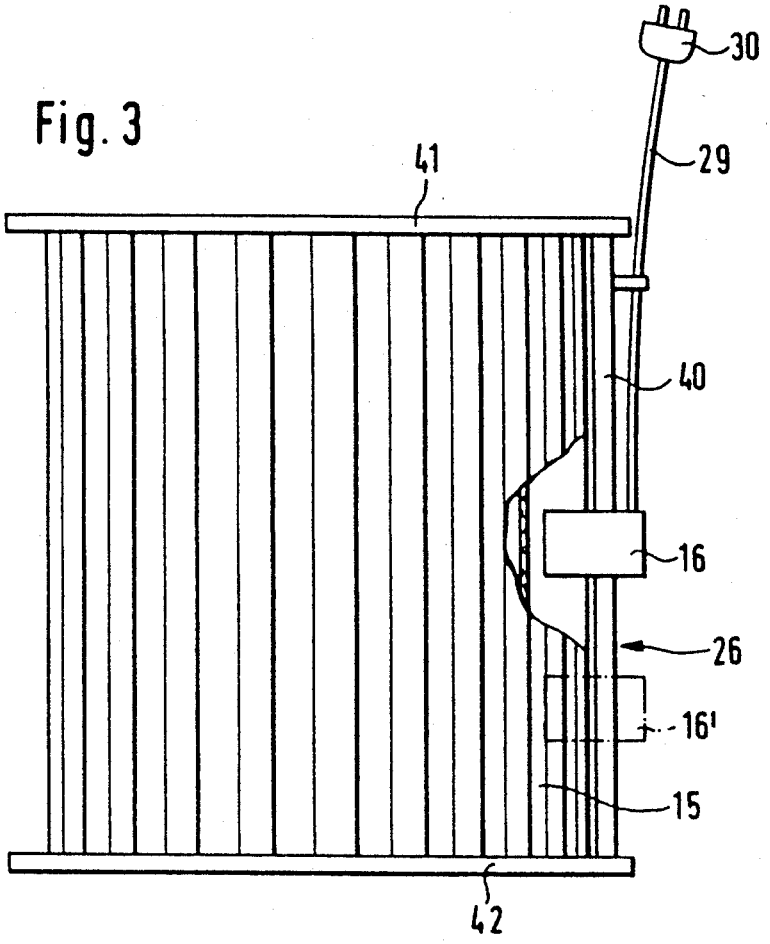
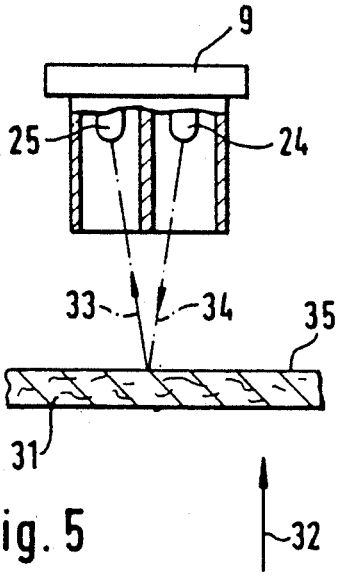
Fig. 5
Fig. 4
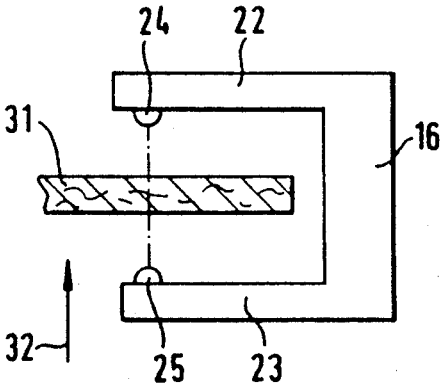

APPARATUS FOR INDICATING HOW DIRTY AN AIR FILTER IS IN A VACUUM-CLEANING APPARATUS, IN A ROOM FILTER, ETC.

BACKGROUND OF THE INVENTION

The present invention relates to an apparatus for indicating how dirty an air filter is that is disposed in an air stream for removing dirt therefrom.

Apparatus for monitoring the dirt-loading of an air filter in vacuum-cleaning apparatus such as vacuum cleaners, or of apparatus for cleaning the air of a room, are known. Such apparatus have a measuring arrangement for detecting the pressure differential ahead of and after the air filter of the air stream that is flowing through the filter. As the loading of the filter increases, the pressure differential increases. The detected pressure values are, however, subject to fluctuations, for example with vacuum-cleaning apparatus, since the volumetric flow of the air stream is greatly influenced by the use of the vacuum tool. If during a cleaning procedure the vacuum tool is disposed completely upon the surface that is to be cleaned, the suction air stream is significantly restricted, and changes greatly during the course of work depending upon whether the vacuum tool is partially or completely lifted from the surface that is to be cleaned. The measuring arrangement detects the pressure fluctuation and activates the indicator for showing that it is necessary to change the filter, although in fact it is not necessary for the filter to be replaced. Thus, the operator can only with great uncertainty estimate the filter loading and hence the point in time at which the filter should be cleaned or replaced. The indication for how dirty the air filter is is too imprecise.

Also with air-cleaning apparatus for cleaning the air of a room and/or for humidifying this air, the actual conditions are not advantageous. With regard to the generation of noise, and in order to avoid the formation of drafts, with such apparatus for cleaning the air of a room the velocity of the flow of the air stream, in other words the air volume that flows through the air-cleaning apparatus, is kept low. As a result of the air-conveying system of these apparatus, the vacuum generated by the blower is relatively slight, so that the pressure differential that occurs as air flows through the loaded filter is similarly very low and is therefore very complicated to determine. A further difficulty with air-cleaning apparatus that in addition humidify air is that water and lime deposits form in the filter.

It is an object of the present invention to improve an apparatus of the aforementioned general type in such a way that fluctuations in the volume of the air stream do not lead to incorrect indications of how dirty the air filter is.

BRIEF DESCRIPTION OF THE DRAWINGS

This object, and other objects and advantages of the present invention, will appear more clearly from the following specification in conjunction with the accompanying schematic drawings, in which:

FIG. 3 is a view of a folded filter cartridge with which is associated a forked light unit;

FIG. 4 is a cross-sectional view of a flat filter with which is associated a forked light unit; and FIG. 5 is a cross-sectional view of a flat filter band with which is associated a reflection light unit.

SUMMARY OF THE INVENTION

The apparatus of the present invention is characterized primarily by: an arrangement in the form of a light unit for measuring how dirty the air filter is; and an indicator connected to the light unit.

With the inventive arrangement of a light unit, the dirt-loading of an air filter can be easily and precisely determined, in particular independent of the fluctuations of the volume of the air flow. Thus, the indication activated by the light unit is very precise. The intensity of the delivered beam of light is reduced in conformity with the filter loading, whereby the detected reduction of the emission intensity is converted into an electrical output signal and is evaluated in an analyzer. The analyzer generates electrical operating signals and controls an, for example visual, indication of how dirty the air filter is and/or acts upon a control mechanism, for example to shut the apparatus off if the filter becomes clogged. The operator can easily and precisely recognize when the filter has to be cleaned or replaced with a new filter, or for example with a roller band filter when the loaded filter surface has to be moved forward.

The light unit advantageously operates in the infrared range. It has been shown that with such an emission a high precision with little disruption in operation can be achieved.

The dirt-laden air stream advantageously flows against that outer side of the filter that is remote from the light unit, so that the light unit is disposed in the clean air space of the filter. In this way it is possible to prevent the deposit of dirt on the light unit, which could lead to disruption in operation.

It can be advantageous to distribute a number of light units over the filter that is to be monitored, whereby the output signals of the light units are preferably evaluated as a summation value. It can also be expedient to obtain an average or mean signal, for example by taking an arithmetic average, from the output signals of the light units disposed at different locations of the filter surface, and to compare this arithmetic average with a threshold value or to process this average signal in an analyzer.

One advantageous proposal is to use a reflection light unit as the light unit; forked light units can also be advantageously utilized. The selection of the light unit is determined by the form and configuration of the filter as well as the spatial conditions.

Further specific features of the present invention will be described in detail subsequently.

DESCRIPTION OF PREFERRED EMBODIMENTS

Figure 1:
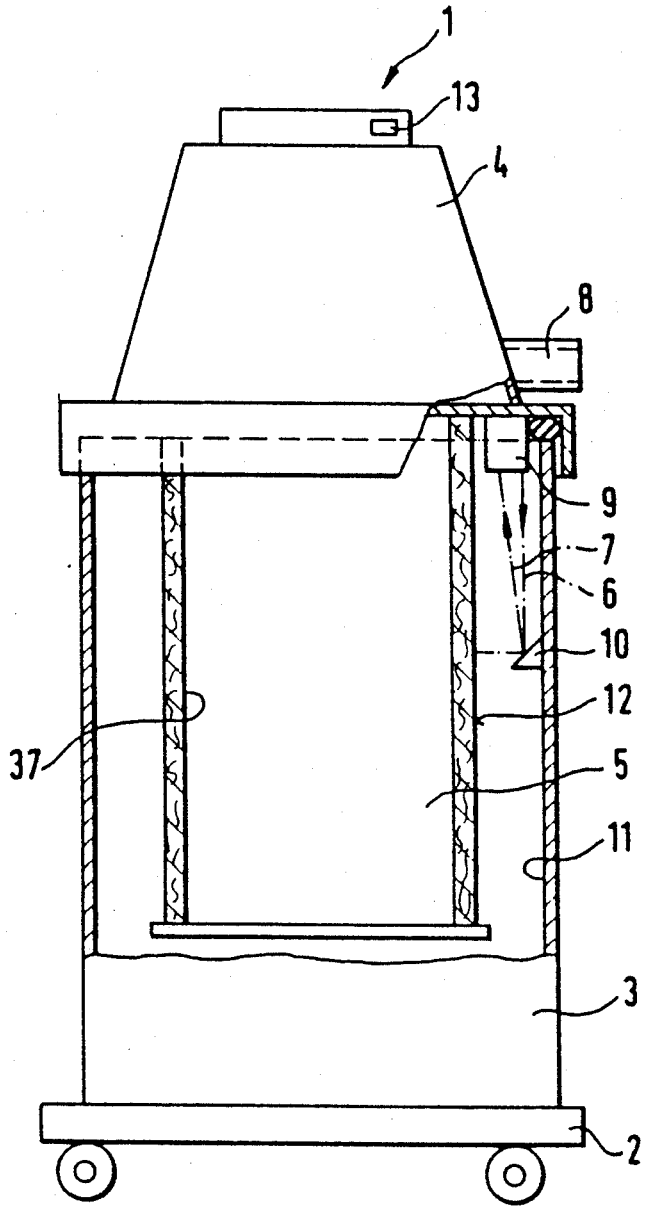
FIG. 1 is a longitudinal cross-sectional view of one exemplary embodiment of the inventive apparatus in a vacuum-cleaning apparatus with a reflection light unit.

Referring now to the drawings in detail, the vacuum cleaning apparatus 1 illustrated in FIG. 1 is provided with a dirt-collecting tank 3 that is disposed on an undercarriage 2. The dirt-collecting tank 3 is closed-off in an airtight manner via a cover member 4. Integrated in a known manner in the cover member 4 is a motor/-blower unit having electrical switching, control, and indicator elements. An indicator 13 is provided to show how dirty the air filter is.

Also secured to the cover member 4 is a replaceable filter 5 that extends axially into the dirt-collecting tank 3. The filter 5 can be a folded or pleated filter, or can also be a filter having a smooth outer surface 12 and/or a smooth inner surface 37. A dirt-laden stream of suction air flows through a vacuum connection 8 of the cover member 4 into the dirt-collecting tank 3, where it flows through the filter 5 and then, as a clean stream of suction air, is blown out into the environment via the motor/blower unit. Connected to the vacuum connection 8 is a non-illustrated vacuum conduit that is connected to a non-illustrated vacuuming tool. The dirt particles contained in the suction air stream are retained by the filter 5. The larger particles of dirt fall down into the dirt-collecting tank 3, while the finer and extremely fine particles of dirt become deposited and accumulate on the surface and within the structure of the filter 5. The more clogged that the filter 5 becomes with particles of dirt, the more restricted is the suction air stream of the vacuum-cleaning apparatus 1. The resistance of the filter 5 to flow becomes greater.

Pursuant to the present invention, the dirt-loading of the filter 5 is detected by a conventional light barrier or unit 9, the construction and operation of which is know per se. In the embodiment illustrated in FIG. 1, a reflection light unit 9 is secured to the cover member 4 of the vacuum-cleaning apparatus 1. The beam of light 6 emitted by the emitter of the reflection light unit 9 is directed approximately axially relative to the dirt-collecting tank 3. i.e. is disposed approximately parallel to the outer surface 12 of the filter 5 that is to be monitored. In order to be able to scan the outer surface 12 of the filter, the beam of light 6 is deflected by a reflector 10 by about 90°, thereby striking the outer surface of the filter 5. On the outer surface 12 of the filter 5, the beam of light 6 is reflected and, via the reflector 10, is reflected as the reflected beam of light 7 to the receiver of the reflection light unit 9. Due to the dirt-loading of the filter 5, the ability of the outer surface 12 of the filter to reflect decreases; in the same way, the intensity of the reflected beam of light 7 is reduced as a function of the dirt loading. In a simple manner a threshold value is set for the intensity of the reflected beam of light 7; when the intensity falls below this threshold value, the light unit 9 is switched through and the indicator 13 is activated to visually indicate that it is necessary to change the filter. It can also be advantageous to determine the change in intensity of the reflected beam of light 7 in comparison to the emitted beam of light 6 and to process this in an electronic analyzer. The analyzer then conveys a control signal to an indicator and/or control mechanism in order to indicate the operating condition that is determined and/or to alter the same.

The reflector 10 for deflecting the axial beam of light into a beam of light that is radial or perpendicular to the filter 5 is advantageously secured to the inner wall 11 of the dirt-collecting tank 3. It can also be advantageous to dispose the reflector 10 on the filter 5 itself or on a holder of the filter 5.

Figure 2:
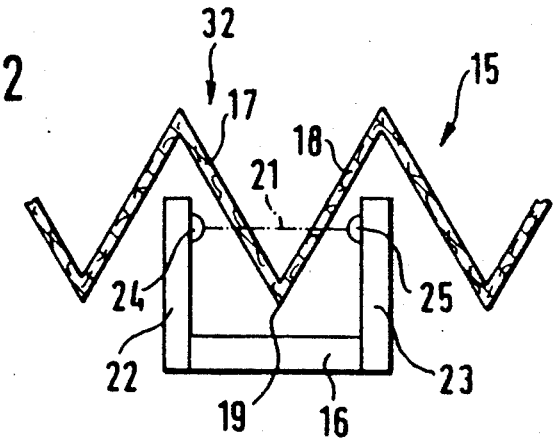
FIG. 2 is a cross-sectional view of a folded filter having a forked light unit disposed at a fold.

The embodiment of the invention illustrated in FIG. 2 shows a folded or pleated filter 15. The light unit that is provided is a forked or bifurcated light unit 16; the use of a refection light unit can also be expedient. The forked light unit 16 is disposed in such a way that two folds or pleats 17 and 18 of the filter 15 that extend at an acute angle relative to one another, along with the fold edge 19 that is formed by the folds, are disposed between the two arms 22 and 23. The emitter 24 and the receiver 25 of the forked light unit 16 are disposed in the vicinity of the ends of the arms 22 and 23. The beam of light 21 delivered by the emitter 24 passes through the filter folds 17 and 18 and strikes the receiver 25. As a result of a dirt-loading of the filter surface and the filter structure, the intensity of the light beam arriving at the receiver 25 is reduced. When the intensity falls below a prescribed threshold value, the forked light unit switches through and activates the indicator 13, which visually indicates that it is necessary to change the filter. The reduction of the intensity can also be evaluated in an electronic analyzer that then controls the indicator 13 and/or effects a change in the operating condition of the apparatus.

As illustrated in FIG. 3, the forked light unit 16 is advantageously securely connected to the cartridge-like folded filter 15 via a holder 26. To establish an electrical connection to the indicator or the analyzer, an electric line 29 and a plug 30 are provided. The holder 26 comprises a rod 40 that is disposed on the side next to the folded filter 15; the ends of the rod 40 are held in the rigid end plates 41 and 42 of the folded filter. The forked light unit 16 is secured to the rod 40, and can preferably be shifted along the rod. The cartridge-like folded filter 15 and the forked light unit 16 can be replaced as a unit. After replacement of the filter 15, it is merely necessary to insert the electrical plug connection. There is no longer any need to adjust the forked light unit after replacement of the folded filter 15. Such an adjustment would be necessary, for example, if the forked light unit 16 were mounted on the cover member 4.

FIG. 4 shows the use of a forked light unit 16 for monitoring a flat filter 31, as it is used, for example, as a so-called exhaust air filter for vacuum-cleaning apparatus or for room air cleaning apparatus. By means of the flat filter 31, fine dust that is still contained in the filtered air stream that is conveyed by the suction fan is removed. Since this exhaust air stream also contains the generally separate cooling air stream of the motor/-blower unit, which is contaminated with the wear from the carbon brushes of commutator motors, the dirt-loading of the cooling air stream is also retained in the flat filter 31.

The described manner of filter monitoring can also be advantageously utilized with flat band filters, the so-called roller band filters, of air cleaning apparatus.

In FIG. 5, a reflection light unit 9 is provided for monitoring a flat filter 31. The light beam 34 delivered by the emitter 24 of the reflection light unit 9 strikes approximately perpendicularly upon the surface 35 of the flat filter 31, where it is reflected and strikes the receiver 25 as the reflected light beam 33. The receiver 25 generates an altered electrical output signal as a function of the intensity of the impinging light beam 33. Thus, the intensity of the received light beam 33, which is altered by the filter loading, is conveyed further as an electrical signal to the electronic analyzer and is converted to an indicator and/or control signal.

The direction of air flow 32 to the filter 15 or 31 with the dirt-laden air stream can be freely selected. The air advantageously flows to the air filter in the direction of the arrow 32 illustrated in FIGS. 2, 4 and 5. In this way, an adverse effect on the operation of the light unit due to deposits of dust is to a large extent avoided, since the light unit is disposed in the cleaned exhaust air stream.

Since the filter material can have differences due to manufacturing tolerances or changes in material as well as color variations, a further light unit is advantageously provided for at least one reference measurement. This reference light unit reads a reference measurement at an unloaded location of the filter, which measurement can then be conveyed as a base value to the electronic analyzer.

It can also be advantageous to distribute a number of light units 16, 16' over the surface of the filter (FIG. 3) and to then take the intensities of the received beams detected at the individual measuring points and analyze them, for example, as a "summation signal" or arithmetically take an average of these intensities.

It has been shown that with the light units that are utilized (forked light unit, reflection light unit), the best operating results are achieved with a radiation or emission in the infrared range.

The present invention is, of course, in no way restricted to the specific disclosure of the specification and drawings, but also encompasses any modifications within the scope of the appended claims.

What I claim is:

1. An apparatus for indicating how dirty an air filter is that is disposed in an air stream for removing dirt therefrom, comprising:

an arrangement in the form of a light unit for measuring how dirty said air filter is, said light unit being a forked light unit;

an indicator connected to said light unit;

said filter being a folded filter having folds, each two adjacent ones of which join one another at a common fold edge; and said forked light unit having two arms that extend over two of said folds and their common fold edge such that a beam of light directed from an emitter of said forked light unit to a receiver thereof passes through said two folds, with a dirt-laden air stream being received on a side of said filter remote from said forked light unit.

2. An apparatus according to claim 1, in which said forked light unit provides emission in the infrared range.

3. An apparatus according to claim 1, in which an emitted beam of light from said forked light unit is oriented approximately perpendicular to a surface of said filter.

4. An apparatus according to claim 1, which includes a plurality of said forked light units distributed over said filter that is to be monitored.

5. An apparatus according to claim 4, which includes means for evaluating output signals of said forked light units as a summation value.

6. An apparatus according to claim 1, which includes a holder for securely connecting said forked light unit with said folded filter to form a replaceable unit.

* * * * *